US007156042B2

(12) United States Patent
Vire et al.

(10) Patent No.: US 7,156,042 B2
(45) Date of Patent: Jan. 2, 2007

(54) DEVICE FOR UNWINDING A WIRE PROVIDING DATA TRANSMISSION OF ANY TYPE BETWEEN TWO MOBILE ELEMENTS OPERATING IN A FLUID

(75) Inventors: Rene Vire, Hyeres (FR); Renaud Malaval, Saint Tropez (FR)

(73) Assignee: DCN, Paris (FR)

( * ) Notice: Subject to any disclaimer, the term of this patent is extended or adjusted under 35 U.S.C. 154(b) by 0 days.

(21) Appl. No.: 10/517,432

(22) PCT Filed: Apr. 17, 2003

(86) PCT No.: PCT/FR03/01236

§ 371 (c)(1),
(2), (4) Date: Dec. 10, 2004

(87) PCT Pub. No.: WO03/106914

PCT Pub. Date: Dec. 24, 2003

(65) Prior Publication Data

US 2005/0224614 A1 Oct. 13, 2005

(30) Foreign Application Priority Data

Jun. 12, 2002 (FR) ..... 02 07204

(51) Int. Cl.
*B63G 8/41* (2006.01)

(52) U.S. Cl. ..... 114/322

(58) Field of Classification Search ..... 114/322, 114/312; 405/191
See application file for complete search history.

(56) References Cited

U.S. PATENT DOCUMENTS

| | | | | |
|---|---|---|---|---|
| 4,010,619 | A * | 3/1977 | Hightower et al. | 114/322 |
| 5,752,460 | A * | 5/1998 | Buffman et al. | 114/244 |
| 6,390,012 | B1 * | 5/2002 | Watt et al. | 114/322 |

FOREIGN PATENT DOCUMENTS

| | | |
|---|---|---|
| FR | 2 654 204 | 5/1991 |
| FR | 2 701 108 | 8/1994 |
| GB | 2 175 038 | 11/1986 |
| WO | 96/18865 | 7/1996 |

* cited by examiner

*Primary Examiner*—Lars A. Olson
(74) *Attorney, Agent, or Firm*—Young & Thompson

(57) ABSTRACT

A device for unwinding a wire providing data transmission of any type (instructions or accounts) between two mobile elements (1) and (7) operating in a fluid, includes one or two reels housed in a winder (2). The winder (2), capable of being dissociated from the two mobile elements (1) and (7) includes stabilizing elements for moving away the reeling point from the launching mobile element (7). The invention is applicable to wire-transmission between a submarine and a self-propelled torpedo.

12 Claims, 6 Drawing Sheets

VIEW ACCORDING TO F

VIEW ACCORDING TO G

SECTION C-C

DEVICE FOR UNWINDING A WIRE PROVIDING DATA TRANSMISSION OF ANY TYPE BETWEEN TWO MOBILE ELEMENTS OPERATING IN A FLUID

The technical field of the invention relates to devices for unwinding a wire which brings about the transmission of information of all types (orders or reports) between two moving objects which operate in a fluid.

One of the main applications of the invention is the use thereof for wire-type transmission between a submarine or a surface vessel and a self-propelled torpedo.

In an underwater environment, the transmission of interference-free information between two moving objects is a complex operation since the carrier waves which are available do not allow transmission over a long distance and are generally not reliable. The transmission connection using a cable or a wire allows this problem to be overcome.

In the case of moving objects which are moving at low speed and within a small perimeter, the cables used are generally bulky, are fixed to the moving object and are unwound from the launch vessel.

If the moving object has to move within a large perimeter, whatever its speed, or if the two moving objects move simultaneously along paths which are independent of each other, it is necessary to use cables having a small cross-section which simultaneously unreel from the moving objects as they move and, in this manner, each moving object leaves behind it a wire which is stationary in the fluid, and the stresses are greatly reduced.

This is the case for current torpedoes which move at various speeds over a long distance whilst being controlled by the vessel which launched them.

In this field, many configurations have already been proposed.

The coil of the launch vessel is positioned in a container which is locked to the base of the torpedo launching tube. The wire which unwinds from it is protected by a sheath in order to prevent fractures caused by friction and possible snagging on the protruding portions of the tube. This protective sheath is deployed for the first few meters of the torpedo path whilst being carried thereby.

The sheath is ballasted in order to space it apart from the launcher. However, it has been found that, with the increase in the speed of the submarine, the sheath has a tendency to move so close to it that the wire unreels along the hull and risks becoming caught by the current of water caused by the propeller, which may snap the wire.

The current design of the French container also results in the size of the coil being limited and therefore the length of wire carried by the submarine, which reduces the ability of the submarine to move during the wire-guiding phase.

Submarines of French design launch their torpedoes by means of telescopic jacks, known as "pneumatic rammers"; the pushing force is applied to the rear of the torpedo. Until now, it has always been possible to displace the wire outlet on one of the control surfaces of the weapon so that the rammer applies no pressing force to the sheath or the wire.

However, new internal equipment for torpedoes limits the space at the periphery and no longer allows this solution to be used, which means that the wire outlet has to be positioned in the axis at the rear end of the torpedo.

In the same technical field, the patent filed under the number FR 2 654 204 is known and describes a device for unwinding a wire-type transmission cable for a missile which moves at high speed in a fluid.

The cable is stored in the form of a coil which is integrated in a space around a fairing which is fixedly joined to the moving object which has been launched and it unwinds on request in accordance with the movement of the moving object.

One of the ends of the cable is fixedly joined to the moving object which has been launched and corresponds to the winding layer having the smallest diameter. The other end, which is connected to the container, unwinds from the layer having the largest diameter. In this manner, the cable unwinds and slides over the rear of the structure, with a frustoconical helical curve being formed which closes behind the moving object which has been launched; at the same time, the wire also unwinds from the coil of the container and, in this manner, each point then remains almost stationary relative to the fluid.

This container can be positioned on the deck of a surface vessel or simultaneously launched with the torpedo from a submarine whilst remaining connected to the submarine by means of a cable.

This device for unwinding cable has a number of disadvantages which are connected, in particular, to the shape thereof.

Owing to the shape of the container, the trajectory of the container is not stabilised. When the container and the torpedo are launched simultaneously, the container risks striking the hull of the submarine and thus interfering with the monitoring operations carried out by the acoustic sensors thereof.

Another disadvantage is the size of the container which limits the length of wire with respect to the submarine and therefore reduces its ability to move. The length of wire is also limited by the design of the torpedo.

The object of the present invention is to overcome the above disadvantages by providing a device for unwinding transmission wire, which device is launched simultaneously with the torpedo.

The object of the present invention is also to provide a device which moves the unreeling point away from the hull of the launcher.

A further object of the invention is to provide a device which has a stabilised trajectory in fluid.

Another object of the invention is to propose a device which increases the ability of the submarine to move in accordance with the length of wire available.

To this end, the subject-matter of the invention is a device for unwinding a wire which brings about the transmission of information of all types (orders or reports) between two moving objects which operate in a fluid, in which device the cable is wound on at least one coil which is received in a reel, the reel being arranged between the two moving objects, which device is characterised in that the reel, which can be separated from the two moving objects, comprises means for stabilising the reel in the fluid.

The means for stabilising the reel preferably comprise a keel connected to a fixed plane.

A pushing spacer, which is associated with the reel located between the moving object which has been launched and the launching mechanism thereof, preferably brings about the transmission of the pushing forces during the launching operation.

A connection mechanism can temporarily bring about the connection between the reel and the moving object which has been launched. It may be composed of a ball-on-spring system with calibrated separation stress.

The device may comprise a short protective sheath in which the wire is unreeled and which is connected to the connection mechanism by means of one of the ends thereof.

The reel preferably comprises one or two coils.

If it comprises two coils, a mechanism for regulating the tension of the wire preferably allows the unreeling action to be transferred from the first coil to the second, with the impact which is caused by the variations in length of the transfer loop being eliminated.

An element which is associated with the reel can allow the play between the reel and the end of the pneumatic rammer to be compensated for in order to prevent the impact when the rammer begins to be deployed.

This element is preferably constituted by a flexible foam washer which is arranged between the reel and the pneumatic rammer.

This device has the advantage of allowing the torpedo and the reel comprising the coil(s) of wire to be launched simultaneously. The unreeling point is thus located at the outer side of the two moving objects.

Another advantage is the shape of the reel; a fixed plane which is associated with the keel allows the device to have a stabilised trajectory and thus does not risk striking the hull of the submarine.

The device also has the advantage of moving the unreeling point away from the submarine, which provides protection against potential influences resulting from turbulence in the vicinity of the hull.

The device advantageously offers a great ability for the submarine to move with it being possible to provide two coils in the reel and therefore to allow the wire to be unreeled more rapidly since it is not possible for it to finish unreeling before the end of its connection to the torpedo.

Further features and advantages of the invention will be appreciated from the detailed, non-limiting description below.

This description will be given with reference to the appended drawings, in which.

Figure 1:
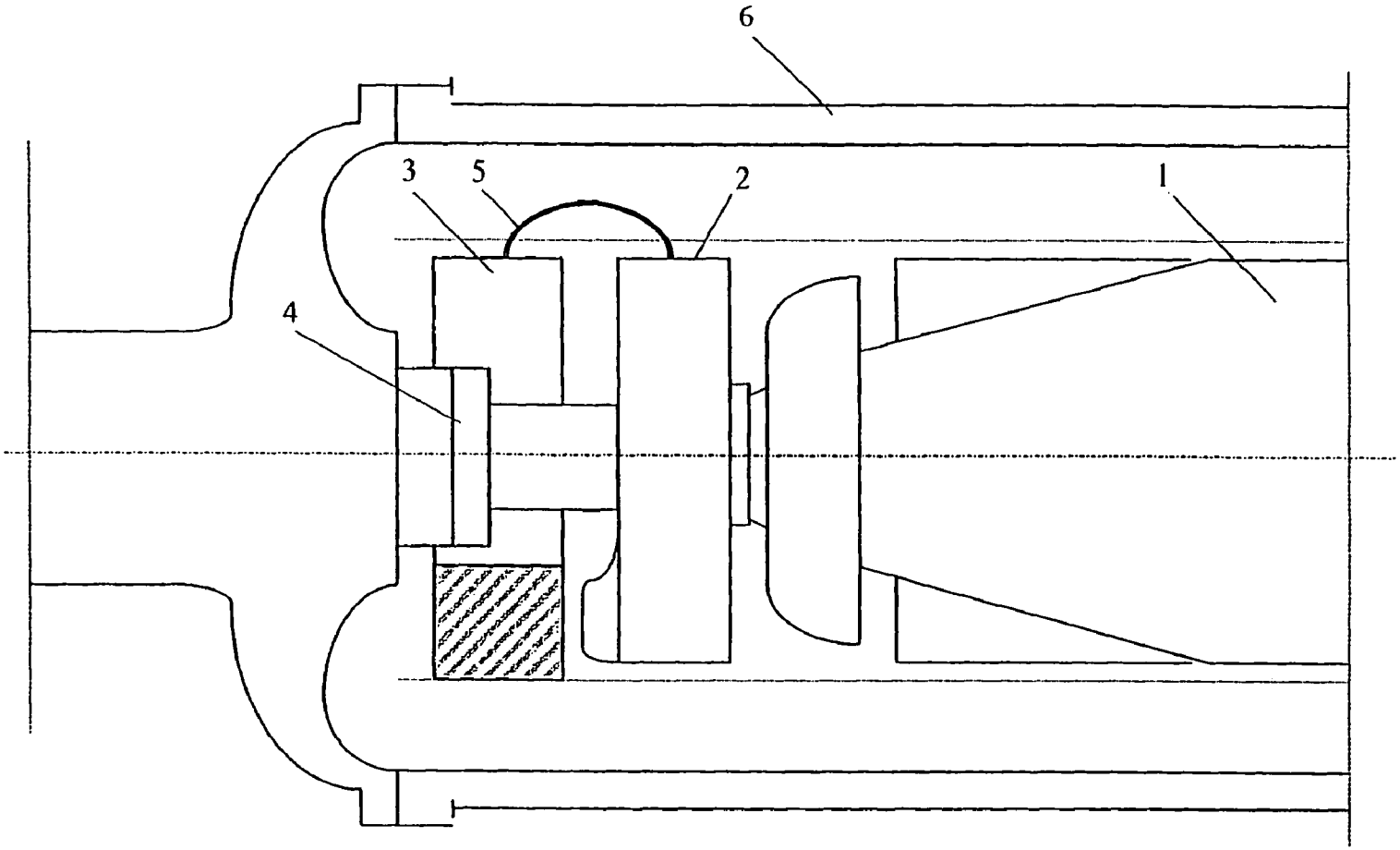
FIG. 1 is a functional diagram during the separation phase of the torpedo.
Figure 2:
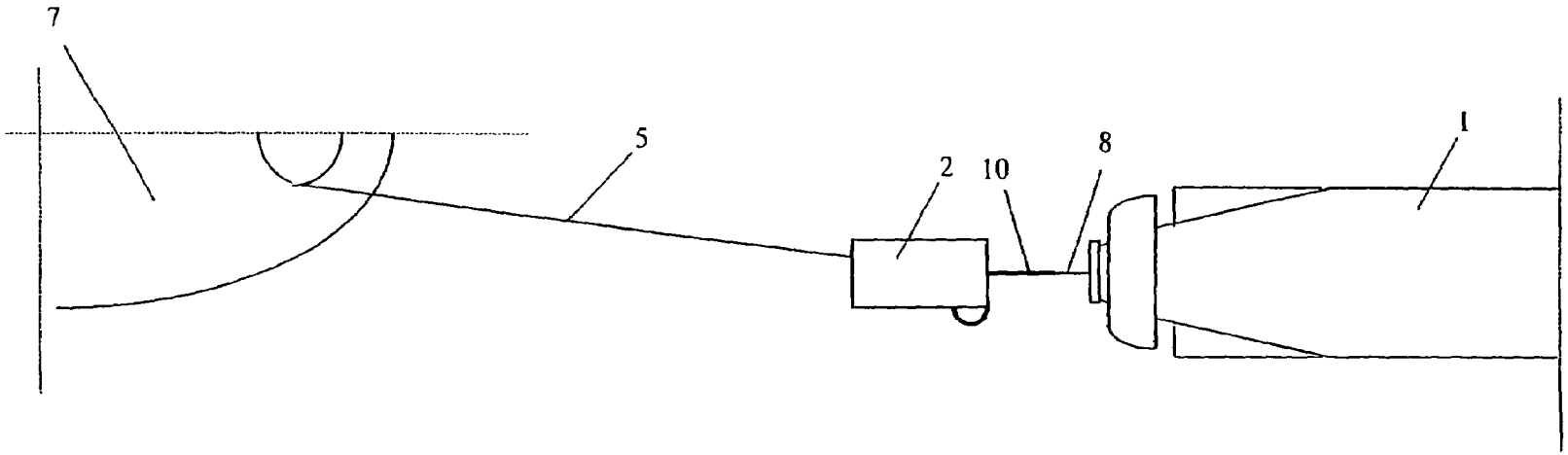
FIG. 2 is a functional diagram during the unreeling of the wire after the reel has been stabilised.
Figure 3:
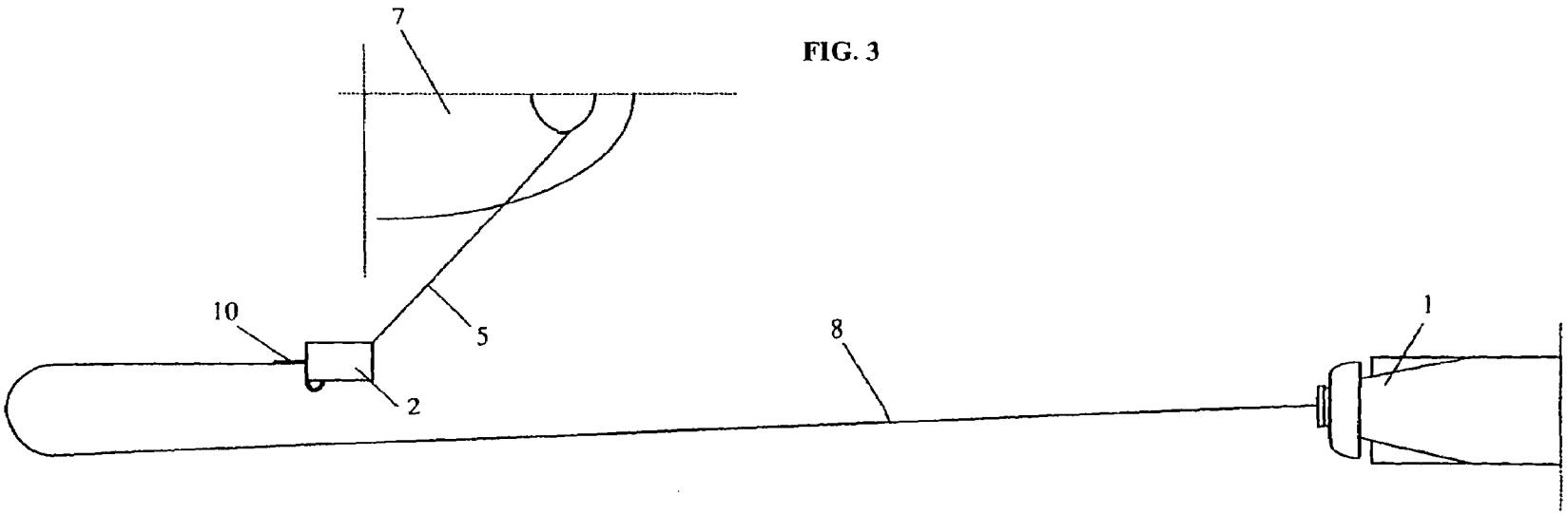
FIG. 3 is a diagram of the assembly before the torpedo is launched.
Figure 4:
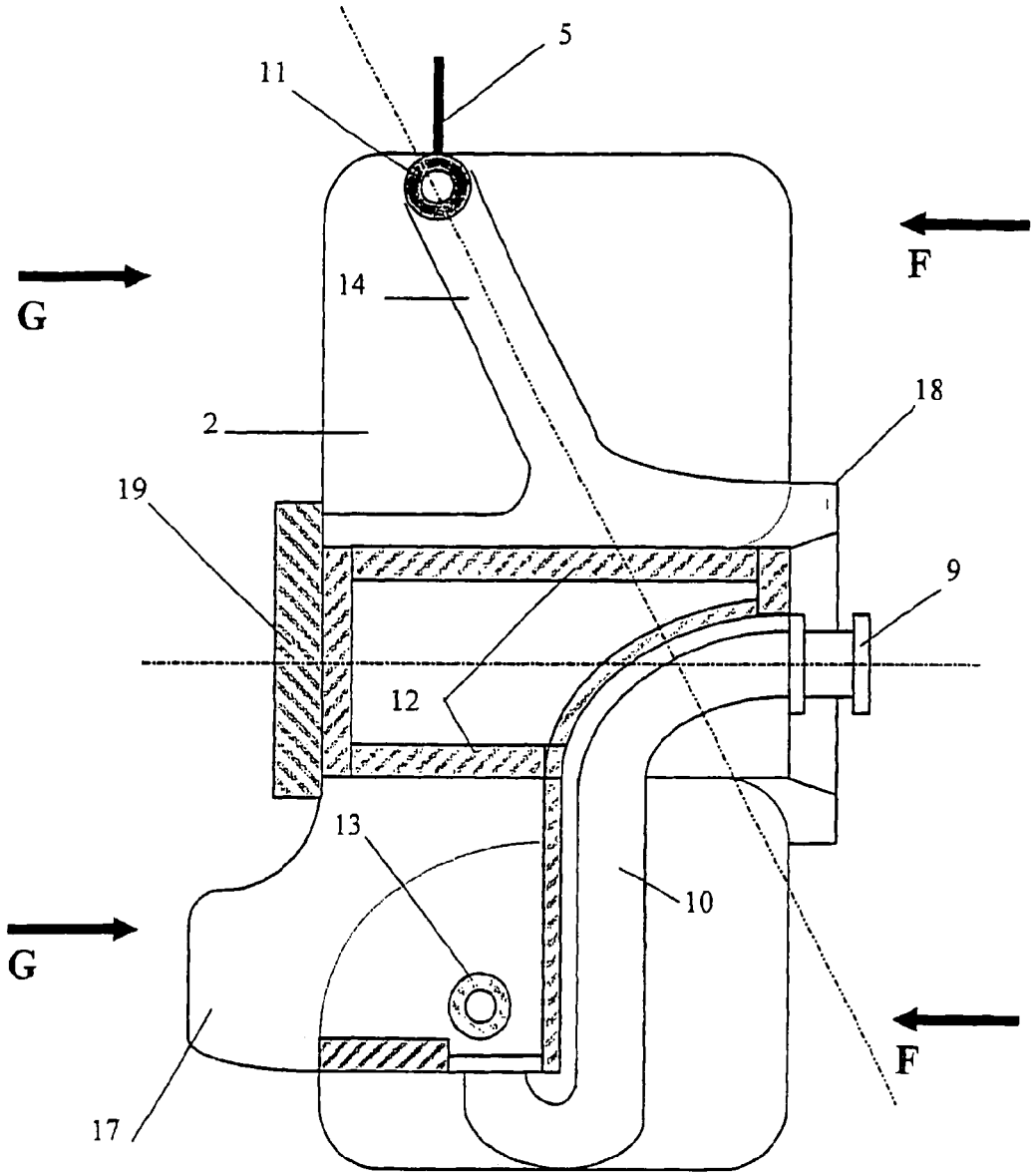
FIG. 4 is a vertical sectioned view of the device.
Figure 5:
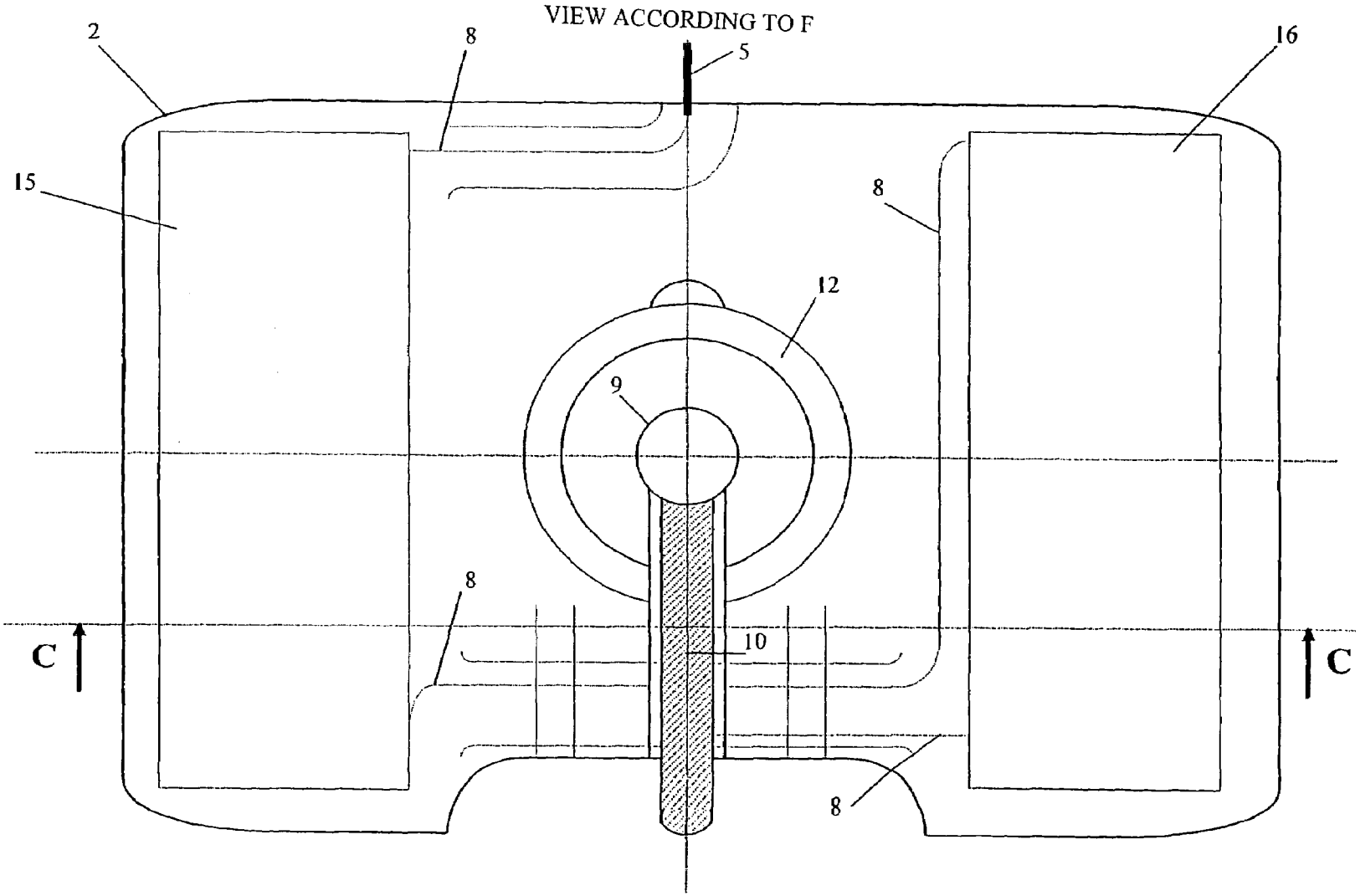
FIGS. 5, 6 and 7 are views according to FIG. 3, illustrating the front and the rear of the device and a cross-section along axis C—C, respectively.
Figure 6:
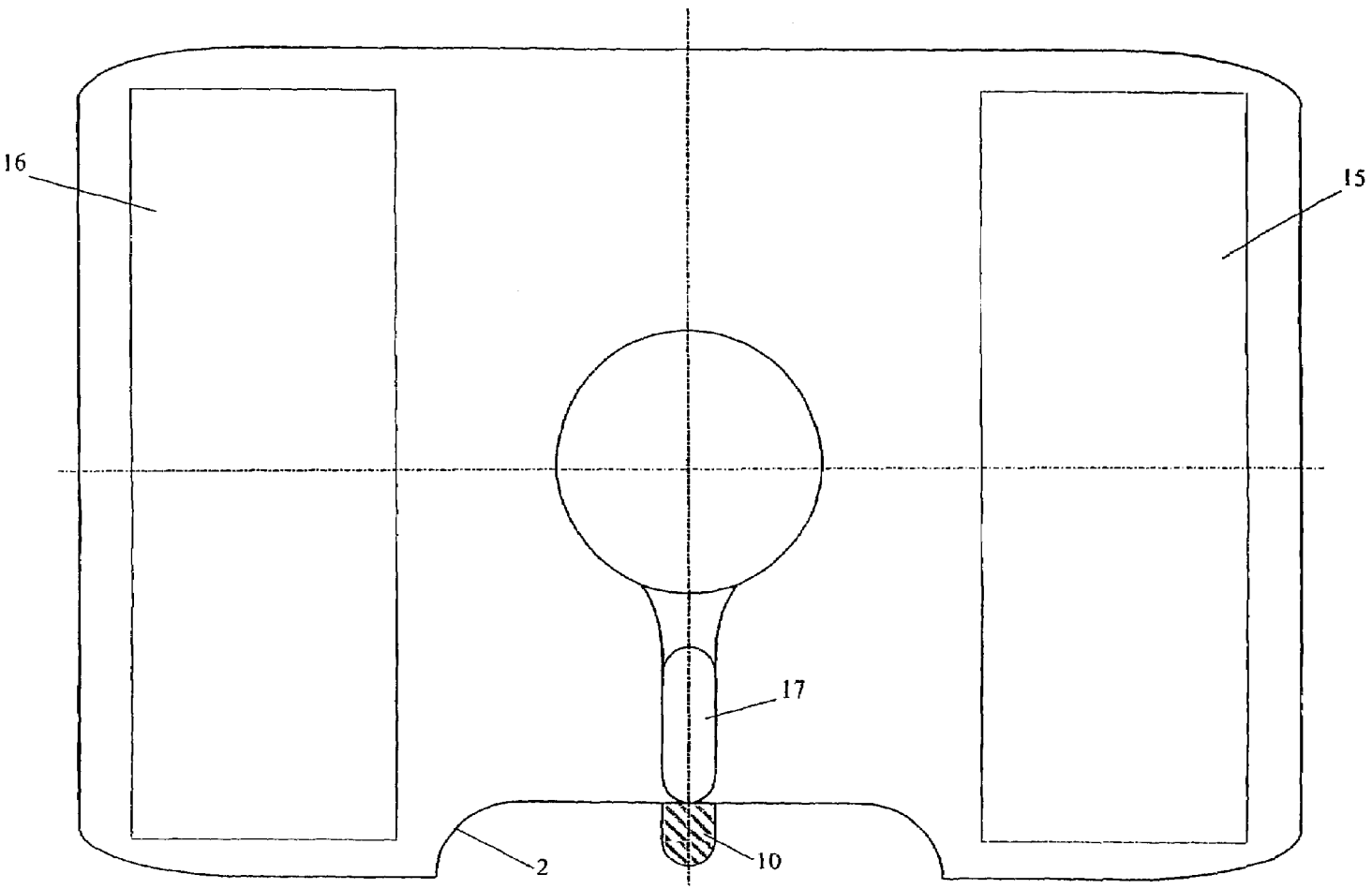
Figure 7:
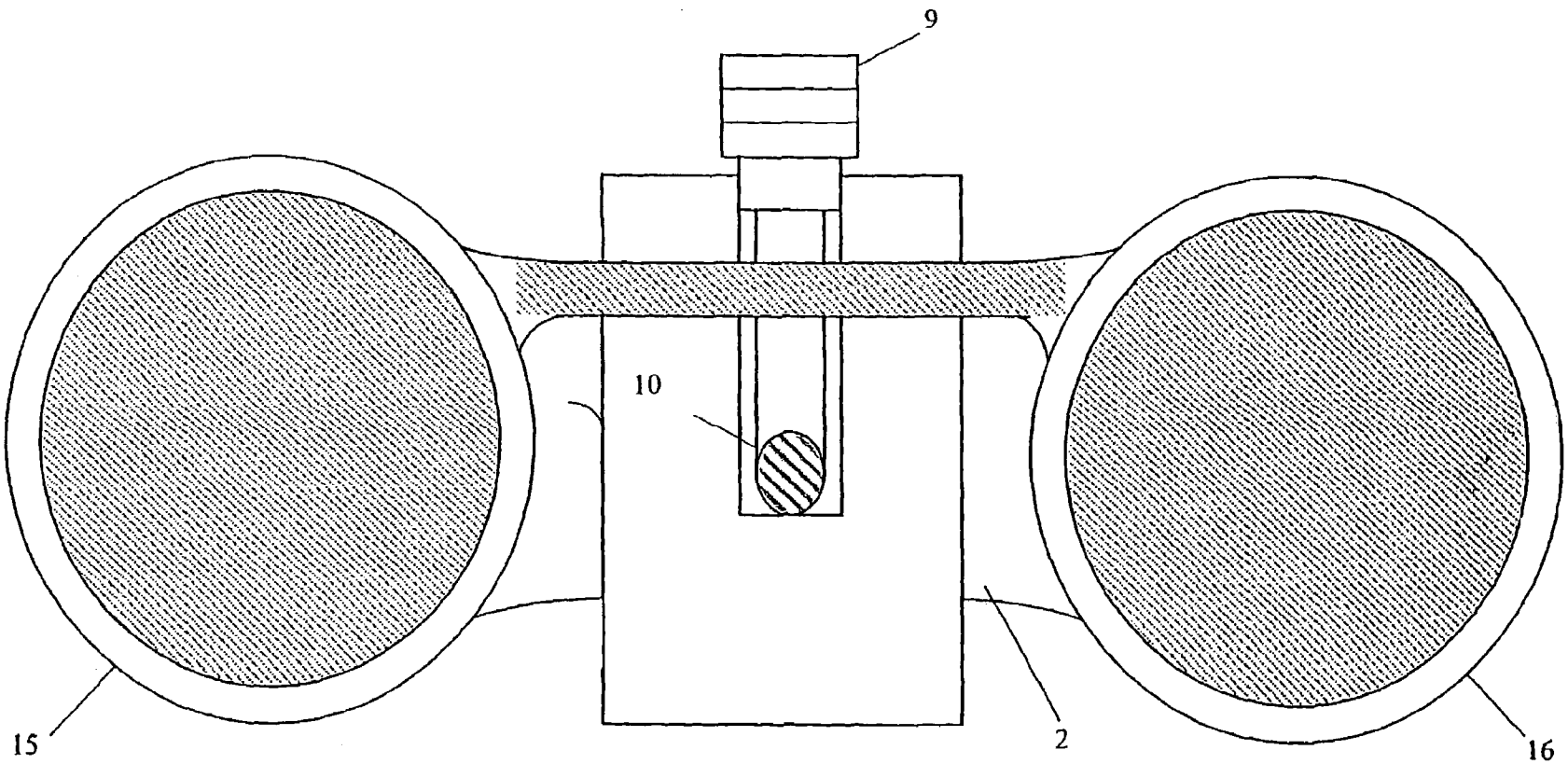

With reference to FIGS. 1 to 7, a device for unwinding a transmission wire between a submarine and a torpedo can be seen.

This device is composed of a reel (2) which comprises one or two wire coils (15) and (16). Before the launching operation, this reel is placed between a launching mechanism, known as a pneumatic rammer (4), and a torpedo (1), inside a launching tube (6) of the launch vessel (7). Other launching methods are possible, such as launching by means of water propulsion, or launching by means of self-starting; this involves modifications to the reel which are not illustrated in the Figures.

The reel is positioned in the axis of the torpedo by means of a centering element (18).

A flexible sheath (10), in which a wire (8) unreels, connects one of the faces of the reel to the torpedo by means of a connection mechanism (9). The connection mechanism is based, for example, on a mechanical ball-on-spring type system which comprises calibrated separation stress and which is identical to the existing solution (any other separation system is possible).

A foam washer (19) is placed between the pneumatic rammer and the reel in order to compensate for the play between the two elements and to absorb the impact resulting from the deployment of the pneumatic rammer. The foam used is preferably flexible and of the elastomer type; the washer will be able to be fixedly joined to the pneumatic rammer, but a rigid foam can also be used; in this case the washer will be destroyed during each launching operation and will necessarily be fixedly joined to the reel.

The reel is connected by means of a cable (5) to a housing (3) which is fixedly joined to the launching tube. This cable, which brings about the transmission of information to the submarine, is connected to the wire coil by means of a connection (11).

A pushing spacer (12) which is placed in the axis of the reel allows the forces of the pneumatic rammer to be transmitted to the torpedo during the launch phase. It comprises a space which is intended to facilitate the passage of the sheath. The reel has a fixed plane (14) which ensures its spacing relative to the submarine.

A keel (17) which is positioned on the lower portion of the reel ensures the stability of the trajectory thereof when it is no longer fixedly joined to the torpedo.

The reel can store one or two coils which are placed at each side of the reel. When the reel comprises two coils, the wire is continuous. In order to transfer the unreeling of the wire from one coil to the other without causing jerking, a mechanism (13) for regulating the tension of the wire allows the resilience of the wire to be compensated for when unreeling from the first coil is complete by the resilience of a spring being adjusted. The wire is then guided by a pulley system and the spring ensures the consistency of tension of the wire.

The device operates as follows: at the time of launching, the pneumatic rammer applies a force to the pushing spacer which is fixedly joined to the reel which in turn pushes the torpedo until the pneumatic rammer is completely deployed. The assembly comprising the reel and torpedo then leaves the launching tube at an initial speed.

The reel, which is then free relative to the torpedo, tilts. However, since it is still connected to the torpedo by means of the connection mechanism, it is pulled as long as the separation stress is not reached.

The motor of the torpedo starts up and the assembly comprising the torpedo and reel moves away from the submarine. In this manner, the cable which connects the reel to the submarine is deployed.

When the cable is completely deployed, the force applied to the connection mechanism by the torpedo becomes greater than the breaking limit, the reel is then fixedly joined to the submarine by means of the cable. The separation stress is reached and the assembly comprising the sheath and reel therefore separates from the torpedo.

A period of instability follows, during which the reel is positioned with the keel directed downwards and retracted relative to the breach in the hole of the plating of the stem. When positioning is complete, the position of the reel depends on the angle of incidence of the axis of the fixed plane thereof with the axis of the vector speed and the value thereof. In this manner, the unreeling point is moved away from the submarine and the reel does not risk striking the submarine.

The torpedo moves away from the reel with the wire contained in the torpedo being unreeled, thus leaving behind it a wire which is stationary in the fluid since wire is also unreeled from the coil contained in the reel. The reel, which is fixedly joined to the submarine by means of the cable, has a stabilised trajectory.

The invention claimed is:

1. Device for unwinding a wire (8) which brings about the transmission of information of all types (orders or reports) between two moving objects (1) and (7) which operate in a fluid, in which device the wire is wound on at least one coil (15) which is received in a reel (2), the reel being arranged between the two moving objects, which device is characterised in that one moving object is launched from the other moving object using a launching mechanism, the reel, which can be separated from the two moving objects, comprises means for stabilising the reel in the fluid, and in that the means for stabilising the reel comprise a keel (17) connected to a fixed plane (14), and is characterised in that a pushing spacer (12), which is associated with the reel located between the moving object (1) which has been launched and the launching mechanism (4) thereof, brings about the transmission of pushing forces during a launching operation.

2. Device according to claim 1, characterised in that it comprises a connection mechanism (9) which temporarily connects the reel and the moving object which has been launched.

3. Device according to claim 2, characterised in that the connection mechanism is composed of a ball-on-spring system with calibrated separation stress.

4. Device according to claim 3, characterised in that the reel comprises a protective sheath (10), in which the wire is unreeled and one end of which is connected to the connection mechanism.

5. Device according to claim 4, characterised in that the reel comprises two coils.

6. Device according to claim 5, characterised in that a mechanism (13) for regulating the tension of the wire allows the impacts caused by the changing of the coil to be eliminated.

7. Device according to claim 1, characterised in that an element which is associated with the reel allows the play between the reel and the launching mechanism to be compensated for.

8. Device according to claim 7, characterised in that the element is constituted by a foam washer (19) which is arranged between the reel and the launching mechanism.

9. Device for unwinding a wire (8) which brings about the transmission of information of all types (orders or reports) between two moving objects (1) and (7) which operate in a fluid, in which device the wire is wound on at least one coil (15) which is received in a reel (2), the reel being arranged between the two moving objects, which device is characterised in that one moving object is launched from the other moving object using a launching mechanism, the reel, which can be separated from the two moving objects, comprises means for stabilising the reel in the fluid, and in that the means for stabilizing the reel comprises a keel (17) connected to a fixed plane (14), characterised in that an element which is associated with the reel allows the play between the reel and the launching mechanism to be compensated for, and characterised in that the element is constituted by a foam washer (19) which is arranged between the reel and the launching mechanism.

10. Device for unwinding a wire (8) which brings about the transmission of information of all types (orders or reports) between two moving objects (1) and (7) which operate in a fluid, in which device the wire is wound on at least one coil (15) which is received in a reel (2), the reel being arranged between the two moving objects, which device is characterised in that one moving object is launched from the other moving object using a launching mechanism, the reel, which can be separated from the two moving objects, comprises means for stabilising the reel in the fluid, and in that the means for stabilising the reel comprises a keel (17) connected to a fixed plane (14), characterised in that a pushing spacer (12), which is associated with the reel located between the moving object (1) which has been launched and the launching mechanism (4) thereof, brings about the transmission of the pushing forces during a launching operation.

11. Device according to claim 10, characterised in that it comprises a connection mechanism (9) which temporarily connects the reel and the moving object which has been launched.

12. Device for unwinding a wire (8) which brings about the transmission of information of all types (orders or reports) between two moving objects (1) and (7) which operate in a fluid, in which device the wire is wound on at least one coil (15) which is received in a reel (2), the reel being arranged between the two moving objects, which device is characterised in that one moving object is launched from the other moving object using a launching mechanism, the reel, which can be separated from the two moving objects, comprises means for stabilising the reel in the fluid, and in that the means for stabilising the reel comprises a keel (17) connected to a fixed plane (14), and characterised in that the element is constituted by a foam washer (19) which is arranged between the reel and the launching mechanism.

* * * * *